US005147058A

United States Patent [19]

Secondé et al.

[11] Patent Number: 5,147,058

[45] Date of Patent: Sep. 15, 1992

[54] EASILY OPENED METAL LID FOR A CONTAINER

[75] Inventors: Jean-Francois Secondé, Metz; Gerard Heurteboust, Roussy-le-Village, both of France

[73] Assignee: Sollac (Societe Anonyme), Paris, France

[21] Appl. No.: 604,974

[22] Filed: Oct. 26, 1990

[30] Foreign Application Priority Data

Oct. 27, 1989 [FR] France ..... 89 14383

[51] Int. Cl.[5] ..... B65D 17/40

[52] U.S. Cl. ..... 220/276; 220/270

[58] Field of Search ..... 220/276, 266, 277, 270

[56] References Cited

U.S. PATENT DOCUMENTS

| | | | |
|---|---|---|---|
| 2,119,533 | 6/1938 | Fink | 220/276 |
| 2,120,186 | 6/1938 | Punte | 220/276 X |
| 2,187,433 | 1/1940 | Punte . | |
| 3,362,570 | 1/1968 | Geiger | 220/276 X |
| 3,674,171 | 7/1972 | Fahlbusch | 220/270 |
| 3,715,050 | 2/1973 | Batchelar et al. | 220/270 |
| 3,820,681 | 6/1974 | Hulse | 220/276 X |
| 4,003,495 | 1/1977 | Grise et al. | 220/268 |
| 4,144,994 | 3/1979 | Brickeen, Sr. | 220/276 X |
| 4,159,061 | 6/1979 | Cornelius et al. | 220/276 X |
| 4,215,795 | 8/1980 | Elser | 220/276 |
| 4,254,890 | 3/1981 | Westphal | 220/276 |
| 4,258,859 | 3/1981 | Westphal | 220/270 |
| 4,753,365 | 6/1988 | Seppala | 220/90.4 |
| 4,762,579 | 8/1988 | Shimizu et al. . | |

FOREIGN PATENT DOCUMENTS 1579365 7/1969 France .

*Primary Examiner*—Stephen Marcus
*Assistant Examiner*—Vanessa Caretto
*Attorney, Agent, or Firm*—Fay, Sharpe, Beall, Fagan, Minnich & McKee

[57] ABSTRACT

The lid for a sealed container openable along a line of reduced strength merely by exerting a pull is of the type comprising a substantially right-angles fold (4) constituting a line of reduced strength which is formed by a stamping operation on a sheet of steel having a thickness less than or equal to 0.16 mm. The line of reduced thickness permits the complete or partial opening of the container. The lid is preferably composed of 0.10 to 0.16 mm thick steel and, at the fold (4), the inside radius of curvature of the lid is 10 to 50 μm and the outside radius of curvature of the lid is 100 to 200 μm. The invention is applicable to sealed metal containers, such as food beverage cans or trays for pre-cooked dishes.

5 Claims, 3 Drawing Sheets

EASILY OPENED METAL LID FOR A CONTAINER

The present invention relates to a metal lid adapted to be mounted on so-called easily opened sealed containers which are opened merely by pulling on the lid which is torn along a line of reduced strength.

Usually, easily opened sealed metal containers, such as food beverage cans or trays for pre-cooked dishes, comprise a metal lid rendered fixed to the upper edge of the body of the can after the latter has been filled. An incision is previously made on the lid and defines a line of reduced strength along which the lid is torn when opening the can. This opening operation is carried out manually by pulling on a tab fixed to the lid after having locally pierced the incision by exerting a pressure or a pull at a point in the vicinity thereof by means of the front part of the tab. Such an opening device is disclosed, for example, in the documents FR 2034997 and FR 2043618.

Such a device is employed on lids made from either aluminium or coated steel (tinplate or chromium plated steel). Steel has a certain number of advantages, in particular its low cost, the good service properties of the containers made from steel and the ease with which the empty containers may be recycled. However, the mechanical characteristics of the usually employed thin steels 0.20 mm to 0.25 mm thick, require that the user exert a relatively large pulling force to open the can, which may in particular result in the well-known slight drawbacks due to the sudden yielding of the resistance at the beginning of the tearing away of the lid. Further, the operation for forming the incision, termed "indentation", is expensive owing to the wear and the cost of the tooling required to achieve this incision and the consequential loss of productivity. Moreover, the indentation, which corresponds to a localized reduction in the thickness of the lid, may deteriorate the protective coating of both sides of the lid. The outer coating must be repaired if a corrosion of the lid in the region of the incision is to be avoided and it is also advisable to repair the inner coating for reasons of food hygiene.

An object of the invention is to reduce the cost of manufacturing lids of easily opened steel cans and also facilitate the opening operation.

The invention therefore provides a lid for a sealed container openable along a line of reduced strength by merely exerting a pull thereon, of the type comprising a substantially right-angled fold constituting said line of reduced strength, characterized in that it is produced by a drawing operation on a sheet of steel having a thickness less than or equal to 0.16 mm.

Preferably, the lid is of steel having a thickness of 0.10 to 0.16 mm and, at the fold, the inside radius of curvature of the lid is 10 to 50 μm, and the outside radius of curvature is 100 to 200 μm.

In one embodiment, this fold forms a closed line located in the vicinity of the periphery of the lid so as to permit a complete opening of the can.

As will have been understood, the invention comprises producing the line of reduced strength along which the lid is opened, not by a pre-incision but by a well-marked fold obtained by drawing a thin sheet of steel. This drawing operation results in a local reduction in the thickness of the lid without removing material. This reduction in thickness is therefore achieved without employing consumable tooling and without deteriorating the coatings of the two sides of the lid.

A better understanding of the invention will be had from the following description with reference to the single sheet of drawings on which:

Figure 1:
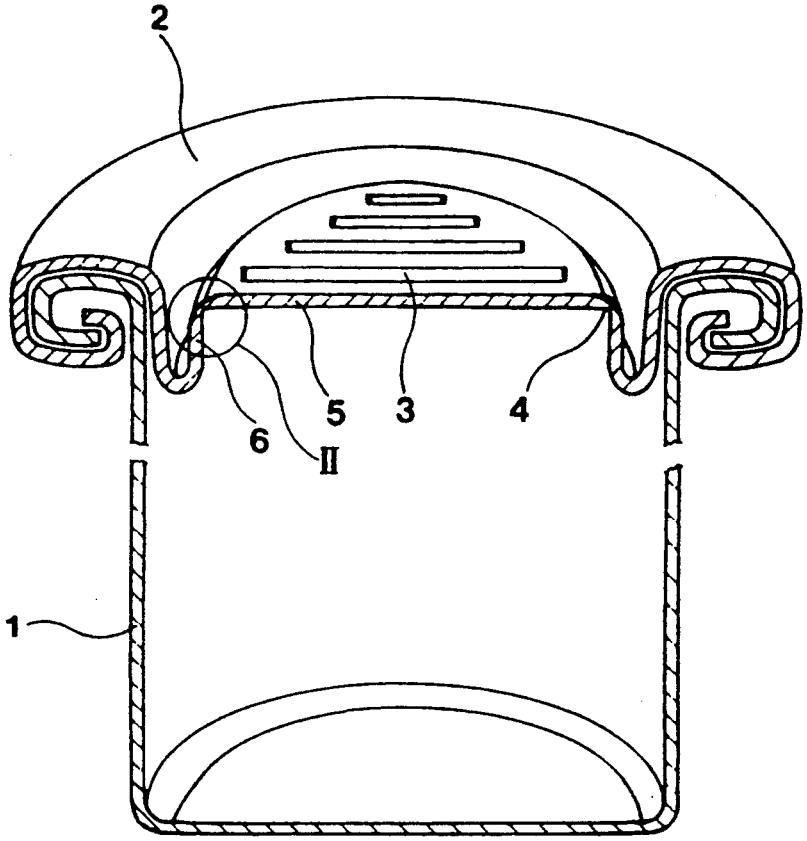
FIG. 1 is a diagrammatic view of a can provided with a lid according to the invention shown in section and in perspective.
Figure 2:
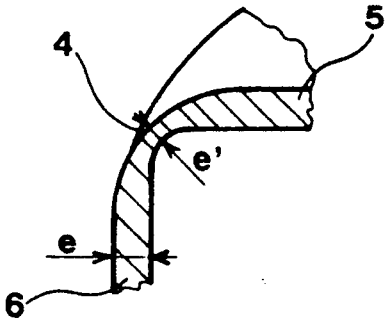
FIG. 2 is an enlarged view of a detail of FIG. 1.
Figure 4:
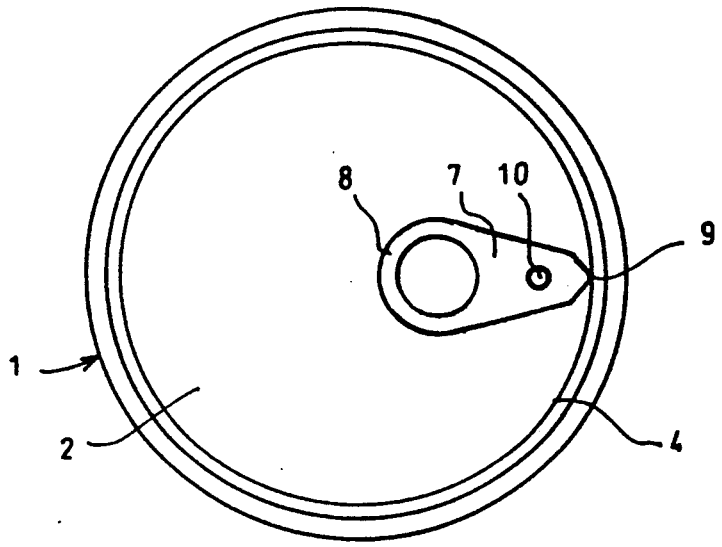
FIG. 4 is a top plan view of the can of FIG. 1.

FIG. 1 shows the body 1 of the can and the lid 2. Before being placed in position on the body of the can, the lid 2 is cut out and shaped by a drawing operation. This drawing operation may for example include a known "panelling" of the lid, i.e. the forming of rectilinear folds 3 constituting shapes in relief facing inwardly or outwardly of the can. These folds have for purpose to facilitate the rolling of the lid onto itself during the opening operation and also to permit the lid to expand and contract during treatments involving a rise in temperature, such as sterilization or pasteurization to which the can may be subjected when filled. These folds may also have the shape of circular steps. It is also in the course of the drawing operation that the lid is folded in such manner as to define in accordance with the invention a line 4 of reduced strength along which the lid will be opened. In order to effectively permit the rupture of the lid along the fold 4, the latter must be well-marked: the horizontal wall 5 and the vertical wall 6 which define the fold make a substantially right angle and, at the fold, the radius of curvature of the lid is very small. FIG. 2 shows the detail of the region II of FIG. 1, i.e. the region of the fold 4 of the lid 2. It shows that the lid 2 has a nominal thickness e, but at the fold 4 this thickness is reduced by the effect of the deformations inherent in the by drawing operation and assumes a minimum value e'. It is this reduction in thickness $\Delta e$ equal to $(e-e')$ which has for result that, after a local piercing of the lid effected at any point of the fold 4, the tearing of the lid occurs along this fold when a pull is exerted on the lid. The piercing and pull are effected by means of a tab 7 provided with a ring 8 shown on FIG. 4 fixed to the lid by a rivet 10, welding or adhesion and identical in principle to those currently employed on preincised lids. An action exerted on the tab by means of the ring applies a high pressure at a point 9 of the fold 4 in such manner as to pierce the lid at this point; a pull on the ring 8 then completes the rupture of the lid which has just been initiated.

The lid must be thin enough to allow an easy tearing along the fold bearing in mind the mechanical properties of the basic material employed. But this material must be sufficiently strong to ensure that the tearing does occur along the fold and not along any direction that the user is incapable of controlling. Preferably, steel is used which has a low or very low carbon content, a thickness of 0.10 to 0.16 mm and an elastic limit of 500 to 600 MPa. The radii of curvature of the lid at the fold are, for the inside radius of curvature, 10 to 50 μm, and for the outside radius of curvature, 100 to 200 μm. The local reduction in thickness $\Delta e$ resulting from the forming of the fold is 70 to 100 μm.

The use of a steel having less thickness than those usually employed has the advantage of a substantial gain in weight, and in a reduction of the force that the consumer must exert for rolling the lid onto itself when opening the box.

Figure 3:
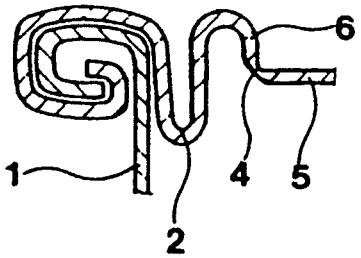
FIGS. 3 and 3A are partial sectional views of the upper part of a can provided with a lid according to another embodiment of the invention, with FIG. 3A being enlarged.
Figure 3A:
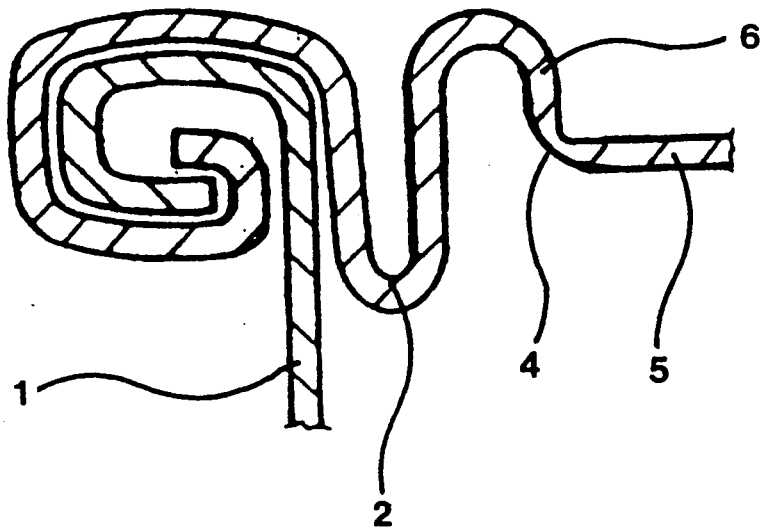

In the embodiment shown in FIGS. 1 and 2, the horizontal wall 5 of the fold 4 which forms the detachable part of the lid is located above the vertical wall 6 which remains attached to the can after the latter has been opened. FIG. 3 illustrates another embodiment of the invention in which the vertical wall 6 surmounts the horizontal wall 5. An advantage of this configuration is that the sharp edge which remains attached to the can after the opening of the latter faces toward the interior of the can with no risk of injuring the user.

The lid 2 is fixed to the body of the can 1 by folding over (seaming) their outer edge portions as diagrammatically represented in FIGS. 1 and 3, or by adhesion or any other known means.

In one embodiment of the invention, the fold constituting the line of reduced strength forms a closed line located in the vicinity of the periphery of the lid so as to permit a complete opening of the can.

Figure 5:
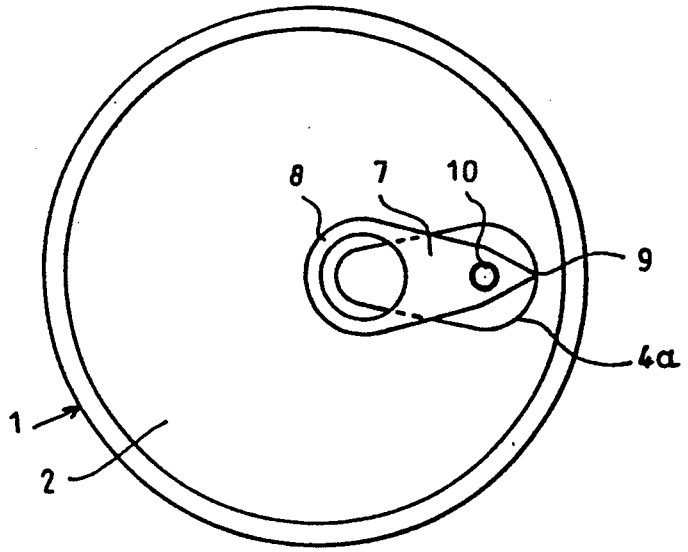
FIG. 5 is a top plan view of a lid according to still another embodiment of the invention.

It must be understood that the scope of the invention is not intended to be limited to the embodiment just described and represented. In particular, metals other than steel may be used to form the lid, and thicknesses other than those mentioned hereinbefore may be adopted. The essential requirement is that the lid be sufficiently tearable and stiff to allow the proposed opening method to be carried out. Further, the fold 4A forming the line of reduced strength may be limited merely to a portion substantially less than the whole of the lid 2 (FIG. 5) so as to result in a partial opening of the can. In this way an opening in the shape of a pouring spout may be formed, namely of the type conventional in beverage cans.

What is claimed is:

1. Lid for a sealed container openable along a line of reduced strength by merely exerting a pull thereon, said lid comprising a sheet of steel having at thickness of not more than 0.16 mm, a horizontal wall having a first thickness, a vertical wall having the first thickness and, a substantially right-angled fold therebetween, said fold constituting said line of reduced strengh and having a curved inner wall and a curved outer wall, said fold having a second, lesser, thickness than said first thickness and being a result of a drawing operation on the sheet of steel.

2. Lid according to claim 1, wherein said sheet of steel has a thickness of 0.10 to 0.16 mm.

3. Lid according to claim 1, wherein, at said fold, the lid has an inside radius of curvature of 10 to 50 μm and an outside radius of curvature of 100 to 200 μm.

4. Lid according to claim 1, wherein said fold constitutes a closed line located in the vicinity of the periphery of the lid so as to permit a complete opening of the container.

5. Lid according to claim 1, wherein said fold constitutes a closed line defining a portion of the lid which is substantially smaller than the whole of the lid so as to permit a partial opening of the container.

* * * * *